US010717306B2

(12) United States Patent
Shapiro et al.

(10) Patent No.: US 10,717,306 B2
(45) Date of Patent: Jul. 21, 2020

(54) WEB BUFFERS WITH SYNCHRONOUS MOVING CARRIAGES

(71) Applicant: HEWLETT-PACKARD DEVELOPMENT COMPANY, L.P., Houston, TX (US)

(72) Inventors: Yuri Shapiro, Ness Ziona (IL); Yaron Cohen, Ness Ziona (IL); Michael Bobritsky, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/191,220

(22) Filed: Nov. 14, 2018

(65) Prior Publication Data

US 2019/0077172 A1 Mar. 14, 2019

Related U.S. Application Data

(63) Continuation of application No. 15/471,270, filed on Mar. 28, 2017, now Pat. No. 10,150,310.

(51) Int. Cl.

| | |
|---|---|
| ***B41J 15/00*** | (2006.01) |
| ***B41J 13/00*** | (2006.01) |
| ***B41J 3/54*** | (2006.01) |
| *B41J 15/18* | (2006.01) |

(52) U.S. Cl.

CPC ..... *B41J 13/0009* (2013.01); *B41J 3/543* (2013.01); *B41J 15/005* (2013.01); *B41J 15/18* (2013.01)

(58) Field of Classification Search

CPC ..... B41J 13/0009; B41J 15/005; B41J 3/543; B41J 15/18

See application file for complete search history.

(56) References Cited

U.S. PATENT DOCUMENTS

| | | | | |
|---|---|---|---|---|
| 3,652,793 | A | 3/1972 | Farr | |
| 4,360,137 | A * | 11/1982 | Noe | B21C 49/00 226/118.2 |
| 4,798,353 | A * | 1/1989 | Peugh | B65H 20/34 226/113 |
| 4,915,282 | A | 4/1990 | Martin et al. | |
| 5,582,339 | A * | 12/1996 | Focke | B65B 41/12 226/21 |
| 6,321,650 | B1 | 11/2001 | Ogawa | |
| 8,935,980 | B2 | 1/2015 | Ruhm et al. | |
| 9,469,095 | B2 | 10/2016 | Peleg et al. | |
| 2005/0139713 | A1 * | 6/2005 | Weber | B65H 20/34 242/418.1 |
| 2005/0156005 | A1 | 7/2005 | Coufal | |
| 2008/0112746 | A1 | 5/2008 | Yamamoto | |
| 2012/0299991 | A1 | 11/2012 | Wakita | |
| 2013/0233191 | A1 | 9/2013 | Mo | |

FOREIGN PATENT DOCUMENTS

| | | | |
|---|---|---|---|
| EP | 1498249 | A1 | 1/2005 |

* cited by examiner

*Primary Examiner* — Yaovi M Ameh
(74) *Attorney, Agent, or Firm* — Fabian VanCott

(57) ABSTRACT

A printing device that may include a first print engine, a second print engine, and a web buffer device disposed between the first and second print engines to maintain an amount of web substrate therein, wherein the web buffer includes a first and second movable carriage, with at least one rotatable roller coupled to each of the two carriages and wherein the first and second movable carriages move synchronously away and toward each other to alter an amount of web present in the web buffer.

20 Claims, 8 Drawing Sheets

WEB BUFFERS WITH SYNCHRONOUS MOVING CARRIAGES

BACKGROUND

A web substrate printing device, often called a web press, is used in large-scale printing operations. The web substrate printing device is fed a continuous roll of print media or web substrate into the print engine for application of a printed image on at least one surface of the web substrate.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
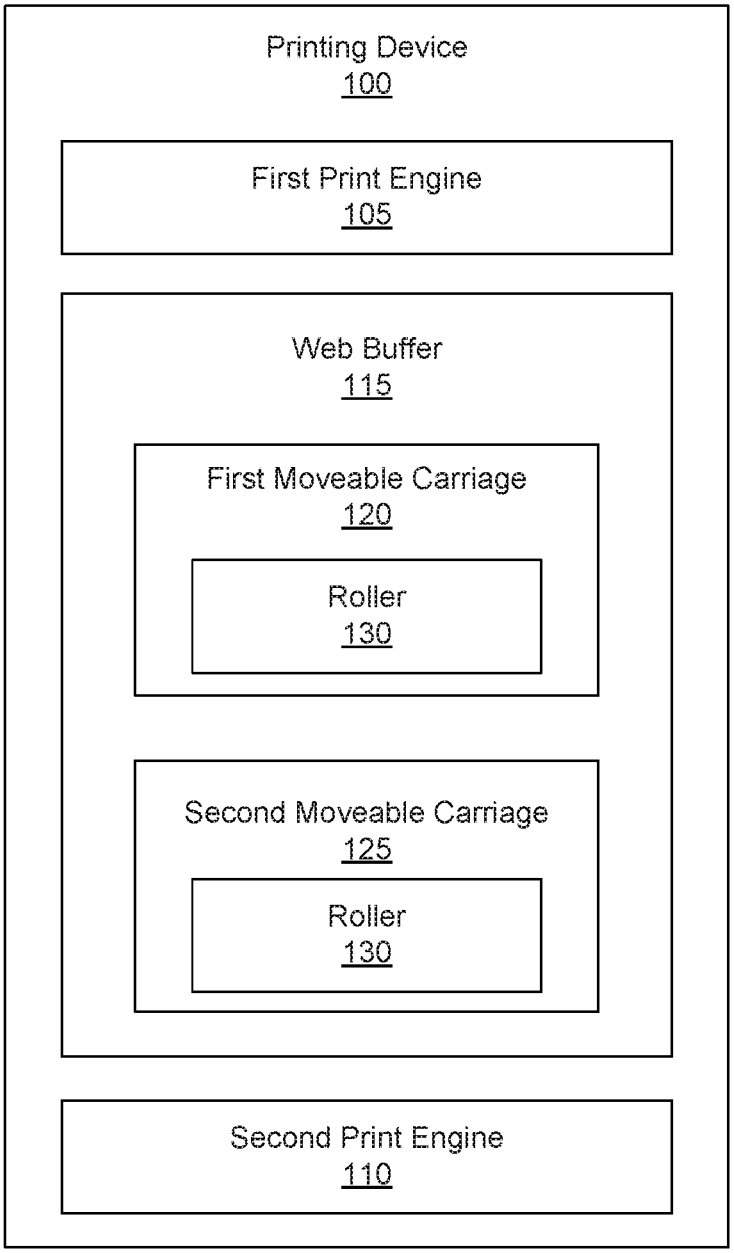
FIG. 1 is a block diagram of a printing device according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, a web substrate printing device continuously applies an image to a roll of web substrate as the web substrate is passed through a print engine of the web substrate printing device. As the web substrate is fed through the print engine, a number of printing fluids may be applied to the web substrate by the print engine to form desired text and/or images on the web substrate. The use of a web of substrate allows for the web substrate printing device to feed the web substrate through the print engine without having to individually feed separate sheets of paper. Consequently, time is saved and web substrate loading procedures are simplified. After an image has been printed on the web substrate, the printed portion of the substrate may be cut according to desired dimensions.

In some cases, web substrate printing devices may include two or more printing engines operating in tandem to achieve increased productivity. For example, "dual" web presses may combine two print engines such that the two print engines print on opposite sides of the substrate. However, these devices are to achieve synchronization between the print engines as the web substrate advances in order to simultaneously print the correct images on one or both sides of the substrate while maintaining a specified document print order and alignment between images printed on the web substrate.

Further, as the web substrate exists the first print engine and enters the second print engine, there may be a lag between the operations of the two print engines. This may result in an amount of web substrate being accumulated or depleted between the two print engines. Without enough web substrate for the second print engine, the substrate may be torn or the second print engine may be caused to pause operations while waiting for an available amount of web substrate. If too much web substrate accumulates between the print engines, the web substrate printing device is not working to a maximum efficiency and damage may also occur to the images printed on a surface of the web substrate.

The present specification therefore describes a printing device that may include a first print engine, a second print engine, and a web buffer device disposed between the first and second print engines to maintain an amount of web substrate therein, wherein the web buffer includes a first and second movable carriage, with at least one rotatable roller coupled to each of the two carriages and wherein the first and second movable carriages move synchronously away and toward each other to alter an amount of web present in the web buffer.

The present specification further describes a system for buffering an amount of web substrate that includes a first and second print engine and a web substrate buffer disposed between the first and second print engines receiving and providing a continuous web substrate from and to the first and second print engines respectively, wherein the web buffer includes a first and second movable carriage, with at least one rotatable roller coupled to each of the two carriages and a belt coupled to each of the first and second movable carriages such that rotation of the belt cause the first and second movable carriages to move synchronously with respect to each other.

The present specification may further include web substrate buffer that includes a first movable carriage comprising a first number of rotatable rollers, a second movable carriage comprising a second number of rotatable rollers, and a linear encoder to determine a distance between the first and second number of rotatable rollers and adjust the distance between the first and second number of rotatable rollers to adjust an amount of web substrate maintained within the web substrate buffer.

As used in the present specification and in the appended claims, the term "web substrate" and "substrate is meant to be understood as any type of print media that may receive an image or text thereon. In examples presented herein, a web substrate and/or substrate is a continuous roll of print media that receives an image or text.

Additionally, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a printing device (100) according to an example of the principles described herein. The printing device (100) may include a first print engine (105), a second print engine (110), and a web buffer (115) disposed between the first print engine (105) and the second print engine (110).

The first and second print engines (105, 110) operate in tandem to print to the web substrate. In an example, a software driver executed by a processor, located on either the first and second print engines (105, 110) or apart from them, provides the first and second print engines (105, 110) with data corresponding to the desired images and text to be printed on the web substrate in a format readable by the first and second print engines (105, 110). The data provided by the software driver may include print operations data, feed data, and any other data needed by the first and second print engines (105, 110) to print a desired document, according to a particular application.

The software driver may translate data corresponding to a desired document to be printed to machine-level data for each of the first and second print engines (105, 110) to interpret. The software driver may be configured to coordinate the operations of the first and second print engines (105, 110) to align print operations in the first and second print engines (105, 110) that correspond to each other with a desired portion of web substrate.

The web buffer (115) is disposed intermediate the first and second print engines (105, 110). The web buffer (115) may store a variable amount of web substrate received from the first print engine (105) and feed the web substrate to the second print engine (110).

Each of the first and second print engines (105, 110) may include control circuitry to control operations of a printing module and a feed module. The printing modules may perform the actual print operations on the web substrate, while the feed modules may transport the substrate through the first and second print engines (105, 110). The control circuitry in at least one of the first and second print engines (105, 110) may receive data from an eye mark sensor that detects the presence of visual indicators on the web substrate. By tracking the visual indicators on the web substrate, corresponding print operations may be coordinated between the first and second print engines (105, 110) consistent with principles described herein.

Additionally, the control circuitry in each of first and second print engines (105, 110) may receive information from a web substrate usage sensor within the web buffer (115). In certain examples, the web substrate usage sensor within the web buffer (115) may be a position sensor that detects the position of the rollers (130) in the web buffer (115). In some examples the position sensor is a linear encoder.

The web substrate usage sensor may provide data to the control circuitry corresponding to the amount of web substrate being stored in the web buffer (115) in the context of the capacity of the web buffer (115). This data may be used by the first print engine (105) to stall print operations when the web buffer (115) does not have a capacity to receive additional web substrate from the first print engine (105). Additionally, the data may be used by the second print engine (110) to stall print operations if the web buffer (115) does not have a sufficient amount of web substrate stored therein to provide to the second print engine (110) for its print operations.

The web buffer (115) may also include an actuator, such as a hydraulic actuator and/or an electric motor to reposition a first moveable carriage (120) and a second moveable carriage (125) with their respective rollers (130). This actuator may dynamically translate the first and second moveable carriages (120, 125) in the web buffer (115) as the amount of web substrate stored in the web buffer (115) varies in order to maintain the substrate at a constant operational tension.

In an example, at least one roller may drive in the web buffer (115), such as electric motors, may rotate at least one of a plurality of rollers coupled to the first and second moveable carriages (120, 125) in the web buffer (115) to feed the web substrate through the web buffer (115). Control circuitry within the web buffer (115) may control operations of the web buffer (115), such as by selectively activating the actuator to reposition the rollers (130) and the roller drive(s). Additionally, the control circuitry of the web buffer (115) may communicate with the control circuitry of the first and second print engines (105, 110) to provide web substrate usage data extrapolated from the substrate usage sensor to the first and second print engines (105, 110).

In an example, at least one roller may not be driven by a motor. In this example, the at least one roller allows the web substrate to pass over it while still maintaining a tension on the web substrate as it passes out of the first print engine (105), through the web buffer (115), and to the second print engine (110). In an example, all rollers (130) are not powered by a motor thereby allowing the web substrate to pass over it while still maintaining the tension on the web substrate.

As described herein, the web buffer (115) includes a first moveable carriage (120) and a second moveable carriage (125). Each of the first and second moveable carriages (120, 125) may have any number of rollers (130) coupled thereto. As will be described herein, the first and second moveable carriages (120, 125) are moveable via a belt. The belt may cause each of the first and second moveable carriages (120, 125) to move away and towards each other in a synchronized manner. This is accomplished by, for example, wrapping the belt around two gears separated by a distance. This causes the belt to have a top portion that moves either right or left and a top portion that moves opposite to the top portion. By coupling the first moveable carriage (120) to the top portion of the belt and the second moveable carriage (125) to the bottom portion, rotation of the belt (either clockwise or counterclockwise) results in the first and second moveable carriages (120, 125) either moving towards each other or away from each other. Additionally, the first and second moveable carriages (120, 125) move away or together an equal distance. By moving both the first and second moveable carriages (120, 125) either towards or apart from each other, the web substrate maintained within the web buffer (115) may be decreased or increased, respectively. As described above, the control circuitry may direct the web buffer (115) as to whether to increase or decrease the amount of web substrate maintained in the web buffer (115) so as to provide more web substrate to the second print engine (110) or receive more web substrate from the first print engine (105).

The number of rollers (130) coupled to each of the first and second moveable carriages (120, 125) may be at least one. In an example, the number of rollers (130) coupled to each of the first and second moveable carriages (120, 125) may be four. In an example, the number of roller (130) on each of the first and second moveable carriages (120, 125) may be unequal among each of the first and second moveable carriages (120, 125). In an example, the number of rollers (130) may be greater than four for each first and second moveable carriages (120, 125) in order to increase the length of web substrate maintained or maintainable within the web buffer (115). In an example, some of the total number of rollers (130) are dumb rollers (130) such that they are not driven by any motors and are instead allows to rotate freely with the web substrate. In an example, some of the total number of rollers (130) may have individual motors coupled to them such that the motors cause the rollers to rotate in a specified direction in order to progress the web substrate through the web buffer (115).

Figure 2:
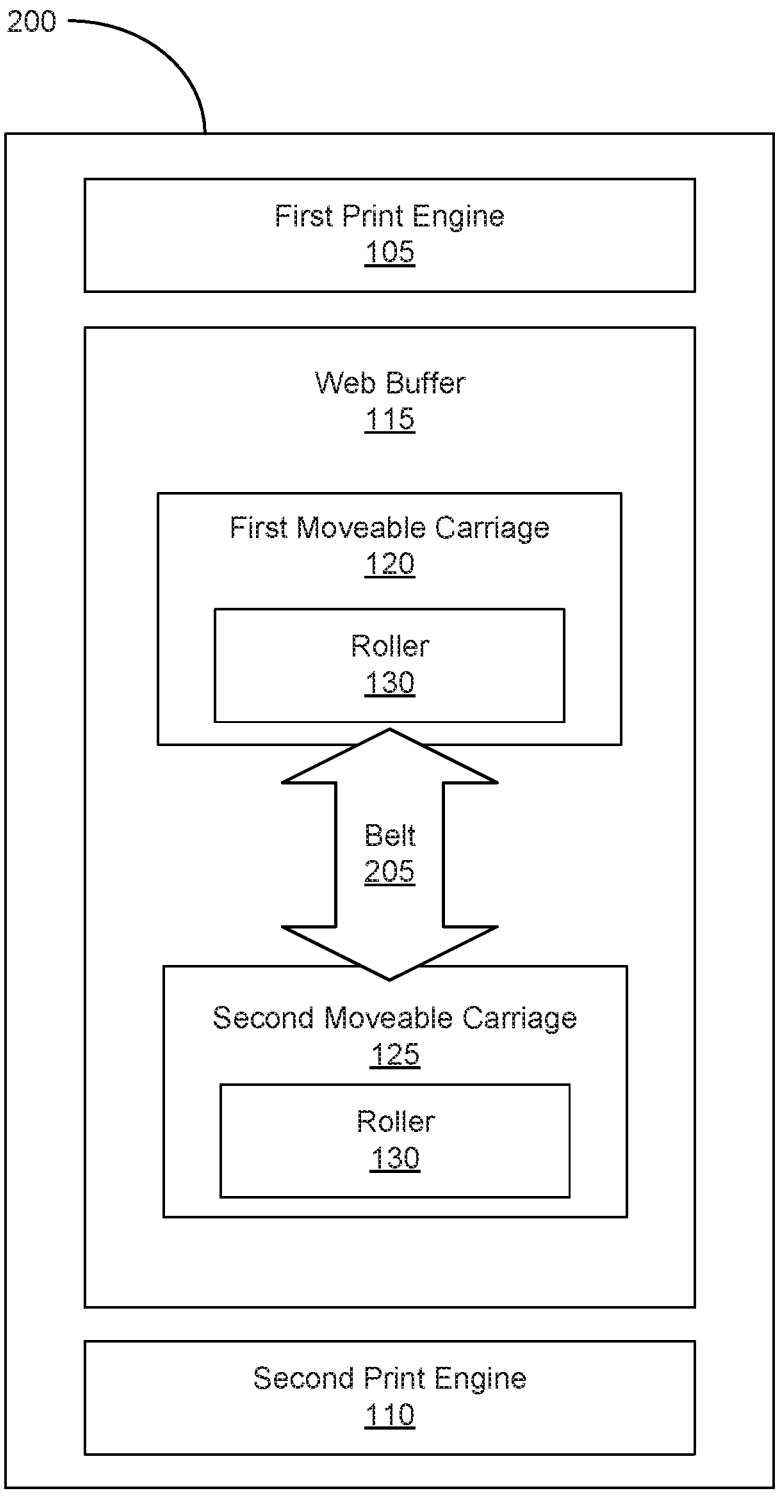
FIG. 2 is a diagram of a system for (describe purpose) according to an example of the principles described herein.

FIG. 2 is a block diagram of a system (200) for buffering an amount of web substrate according to an example of the principles described herein. The system (200) may include the first and second print engines (105, 110) and web buffer (115) as described in connection with FIG. 1 above. The system (200) may include the belt (205) as described herein in connection with FIG. 1 that drives the first and second moveable carriages (120, 125).

In an example, the first and second moveable carriages (120, 125) and the belt (205) may be separated by a wall on which the first and second moveable carriages (120, 125) and belt system may be supported. In this example, the belt system may include two gears placed at apposing ends of the web buffer (115). The belt (205) may be wrapped around the two gears with teeth formed on the belt engaging with cogs formed on the gears. The belt (205) may be secured together at terminal ends using, for example, a tensioning mechanism that can adjust the tension of the belt (205) as it is wrapped around the two gears. At least one motor may be engaged with at least one of the gears to cause the belt to rotate as well. In this example, the belt forms an upper length and lower length of the belt that runs horizontal to each other as well as horizontal to the ground. Because the upper length and lower length of the belt run in opposite directions (right versus left; left versus right) the first and second moveable carriages (120, 125) are coupled to one of either the upper length or lower length. With the first and second moveable carriages (120, 125) being coupled to opposite sides of the belt (205) (upper length or lower length), rotation of the belt will cause each of the first and second moveable carriages (120, 125) to either move towards or away from each other depending on whether the belt (205) is rotated clockwise or counter-clockwise. This moves the first and second moveable carriages (120, 125) together or away from each other as well as also moving them in synchronization such that movement of the first moveable carriage (120) relative to the second moveable carriage (125) is equal. Additionally, because both the first and second moveable carriages (120, 125) move, an additional amount of web substrate may be removed from the web buffer (115) thereby allowing for the second print engine (110) to be provided an additional amount of web substrate when printing operations dictate.

Figure 3:
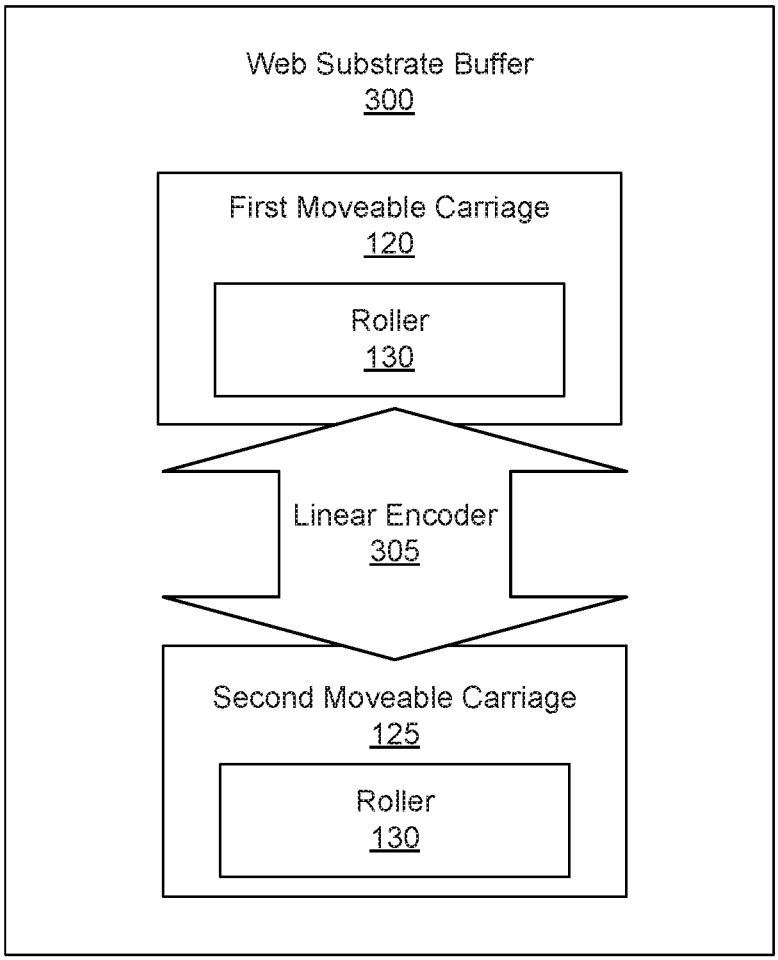
FIG. 3 is a block diagram of a web substrate buffer (300) according to an example of the principles described herein.

FIG. 3 is a block diagram of a web substrate buffer (300) according to an example of the principles described herein. The web substrate buffer (300) may include the first and second moveable carriages (120, 125) with their respective roller (130) as described above. In addition, the web substrate buffer (300) may include a linear encoder (305).

The linear encoder (305) may be any device that can determine the distance between the first and second moveable carriages (120, 125) thereby determining the distance between the rollers (130) coupled to each of the first and second moveable carriages (120, 125). In an example, the information provided by the linear encoder (305) may be provided to the control circuitry of either of the first and second print engines (105, 110) or both. In another example, the information provided by the linear encoder (305) may be provided to a processor of a printing device (100) into which the web substrate buffer (300) is placed. Using this information, the amount of web substrate may be increased or decreased based on the web substrate usage of the first and second moveable carriages (120, 125).

Figure 4A:
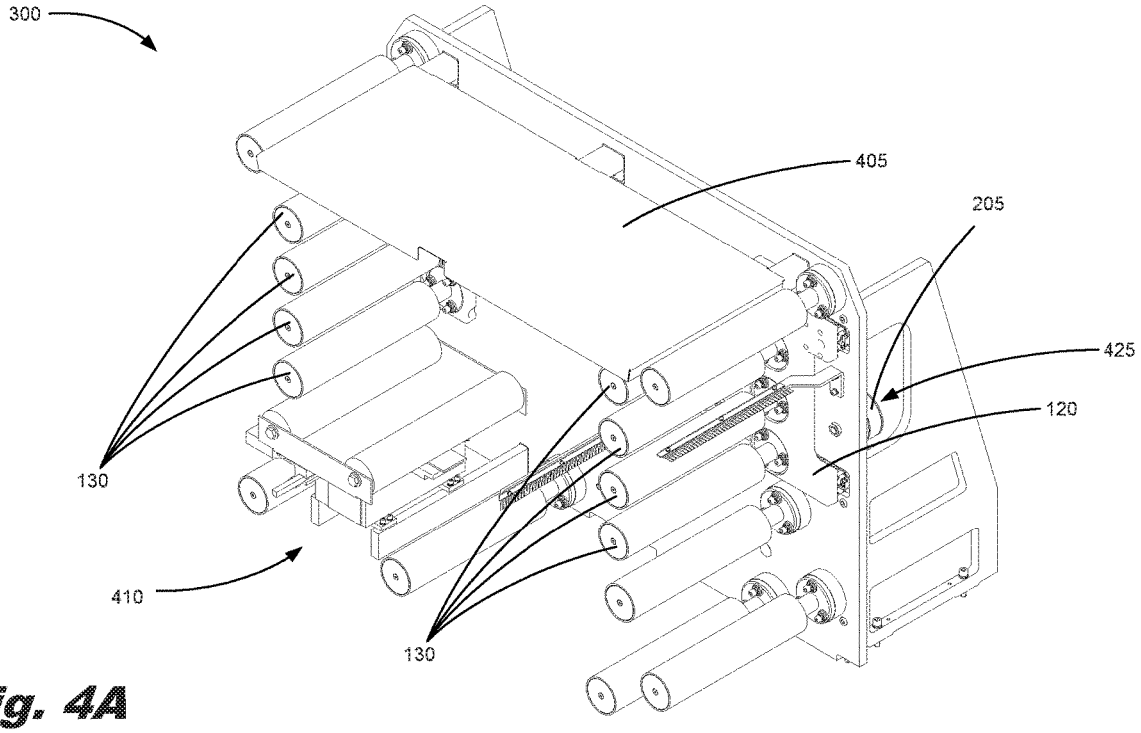
FIGS. 4A and 4B are a perspective and front facing view, respectively, of the front of the web substrate buffer of FIG. 3 according to an example of the principles described herein.
Figure 4B:
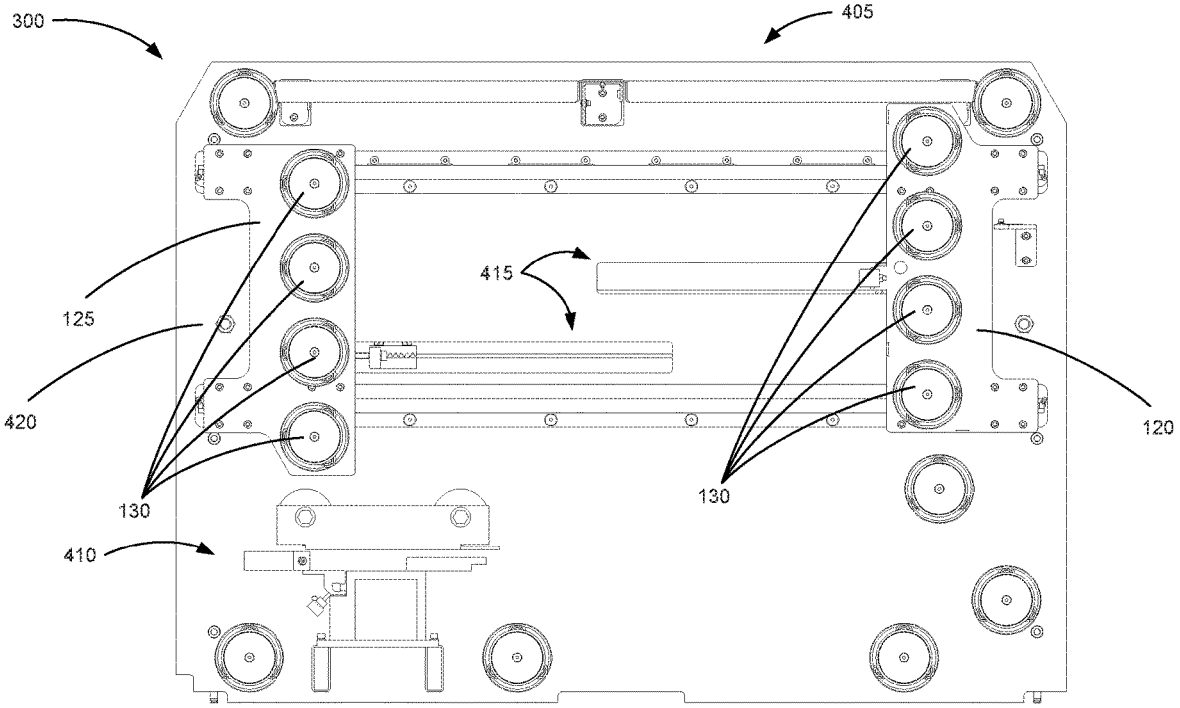

FIGS. 4A and 4B are a perspective and front facing view, respectively, of the front side of the web substrate buffer (300) of FIG. 3 according to an example of the principles described herein. The web substrate buffer (300) may include a first moveable carriage (120) and an opposite second moveable carriage (not shown in FIG. 4A). In the example shown in FIGS. 4A and 4B, each of the first and second moveable carriages (120, 125) have four rollers (130) coupled thereto. The web substrate buffer (300) may further include an inspection table (405) over which the web substrate may pass for an operator of the web substrate buffer (300) to inspect the web substrate after it has been printed on by the first print engine (105). A web substrate guide (410) may also be provided to guide the web substrate out of the web substrate buffer (300) in preparation to be received by the second print engine (110).

A number of slots (415) may also be provided in order for a portion of the first and second moveable carriages (120, 125) to extend through a wall (420) within the web substrate buffer (300). As described herein, the first and second moveable carriages (120, 125) may be coupled to a belt (205) wrapped around a number of gears (425).

Figure 5A:
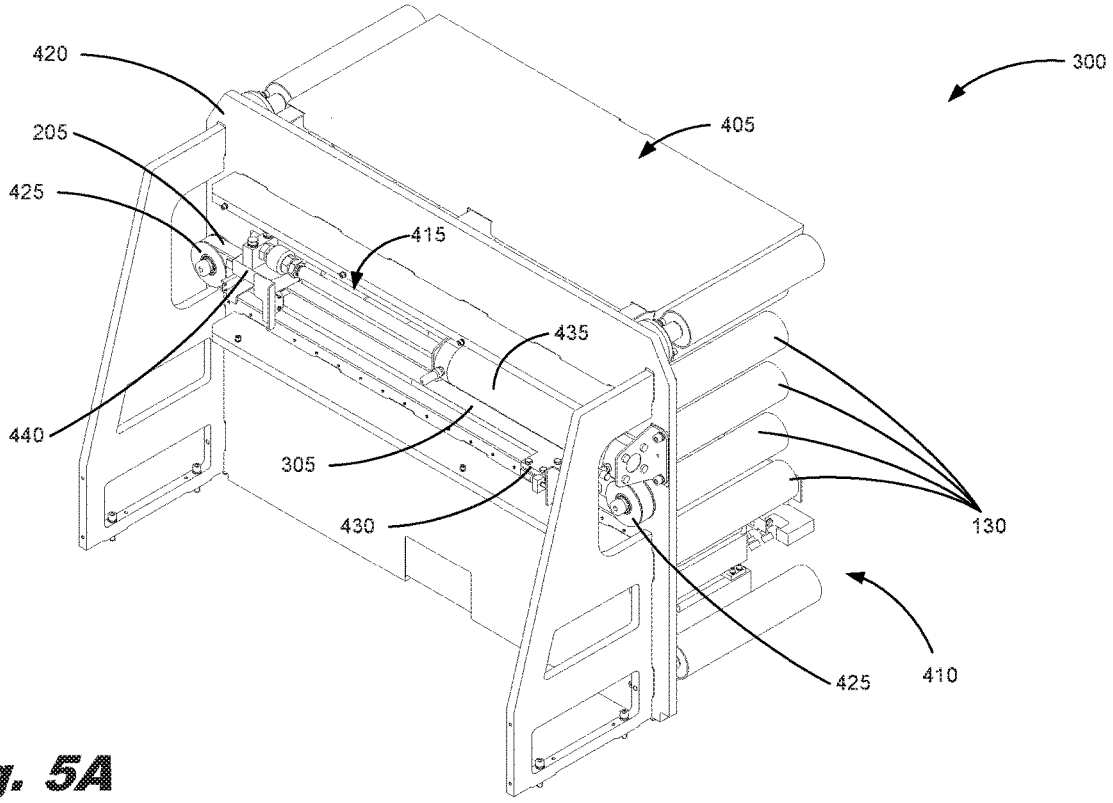
FIGS. 5A and 5B are a perspective and front facing view, respectively, of the back of the web substrate buffer of FIG. 3 according to an example of the principles described herein.
Figure 5B:
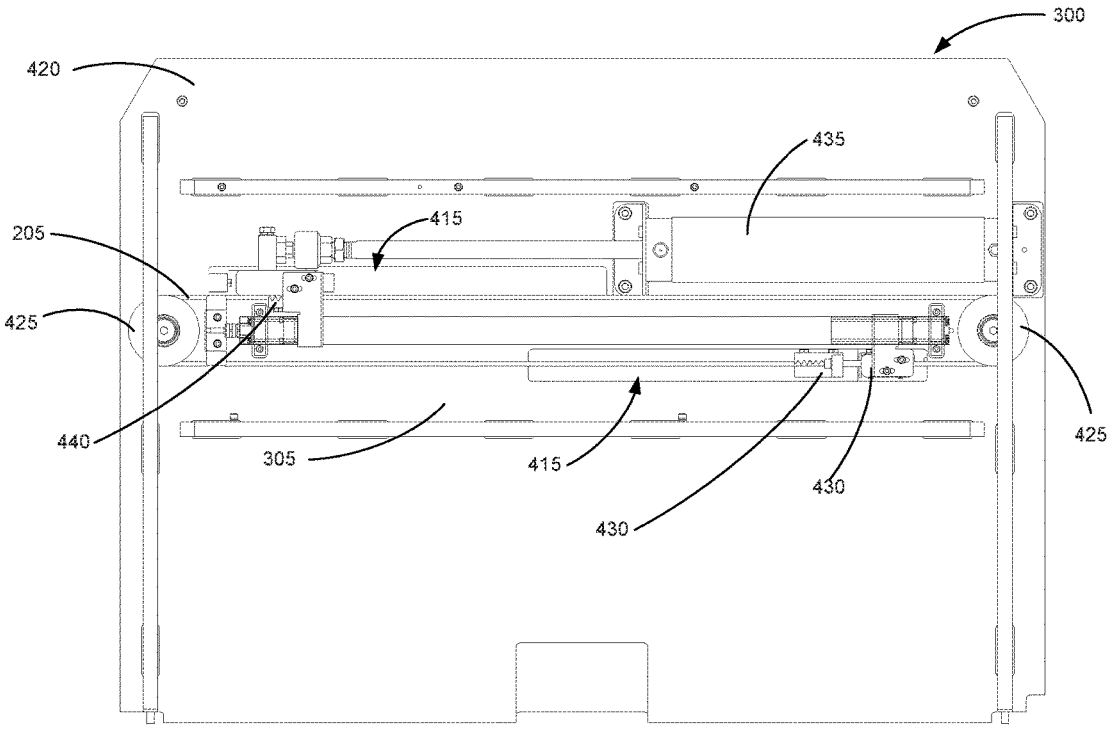

FIGS. 5A and 5B are a perspective and front facing view, respectively, of the back of the web substrate buffer of FIG. 3 according to an example of the principles described herein. As described above, a portion of the first and second moveable carriages (120, 125) may extend through the wall (420) and may be coupled to the belt (205) using a coupler (440). A tensioning mechanism (430) may adjust the tension of the belt (205) as it is wrapped around the two gears (425). The web substrate buffer (300) may further include an actuator (435) that moves the protruding portions of the first and second moveable carriages (120, 125) as described herein. This example may be in lieu of using a motor to drive one of the gears (425). Here, the actuator (435) creates the force and the gears (425) may be free to rotate.

FIGS. 5A and 5B further show the linear encoder (305). The linear encoder (305) is used to determine a current position of either of the first and second moveable carriages (120, 125). This is done by attaching a magnet to the portions of the first and second moveable carriages (120, 125) that protrude through the wall (420). As the magnets pass along a linear portion of the linear encoder (305), the linear encoder (305) detects that position and relays that information to a central controller as described above. In an example, the portion of the first and second moveable carriages (120, 125) that protrudes through the wall (420) may each have a magnet coupled thereto. In an example, one of the protrusions of the first and second moveable carriages (120, 125) that protrudes through the wall (420) has a magnet coupled thereto.

In FIGS. 5A and 5B it can be seen that the protrusion from the first moveable carriage (120) is coupled to the belt (205) at an upper length of the belt (205). Similarly, the protrusion from the second moveable carriage (125) is coupled to the belt (205) at a lower length of the belt (205). As described above, as the belt (205) is caused to rotate in a clockwise manner according to FIG. 3B, the first and second moveable carriages (120, 125) are brought together. Additionally, because the first and second moveable carriages (120, 125) are each coupled to the belt (205) at a fixed location, the first and second moveable carriages (120, 125) are moved in a synchronous manner such that movement of the first moveable carriage (120) a specific distance is equal in distance to the movement of the second moveable carriage (125) and vis-a-versa.

FIG. 5B also shows the linear encoder (305) with a first magnet (445) and a second magnet (450). As described above, the protruding parts of the first and second moveable carriages (120, 125) may each have a magnet (445, 450) coupled thereto to interact with the linear encoder (305) and provide positional data regarding the first and second moveable carriages (120, 125). In an example, however, a single magnet (445, 450) may be implemented on either the protruding portion of the first and second moveable carriages (120, 125).

Figure 6:
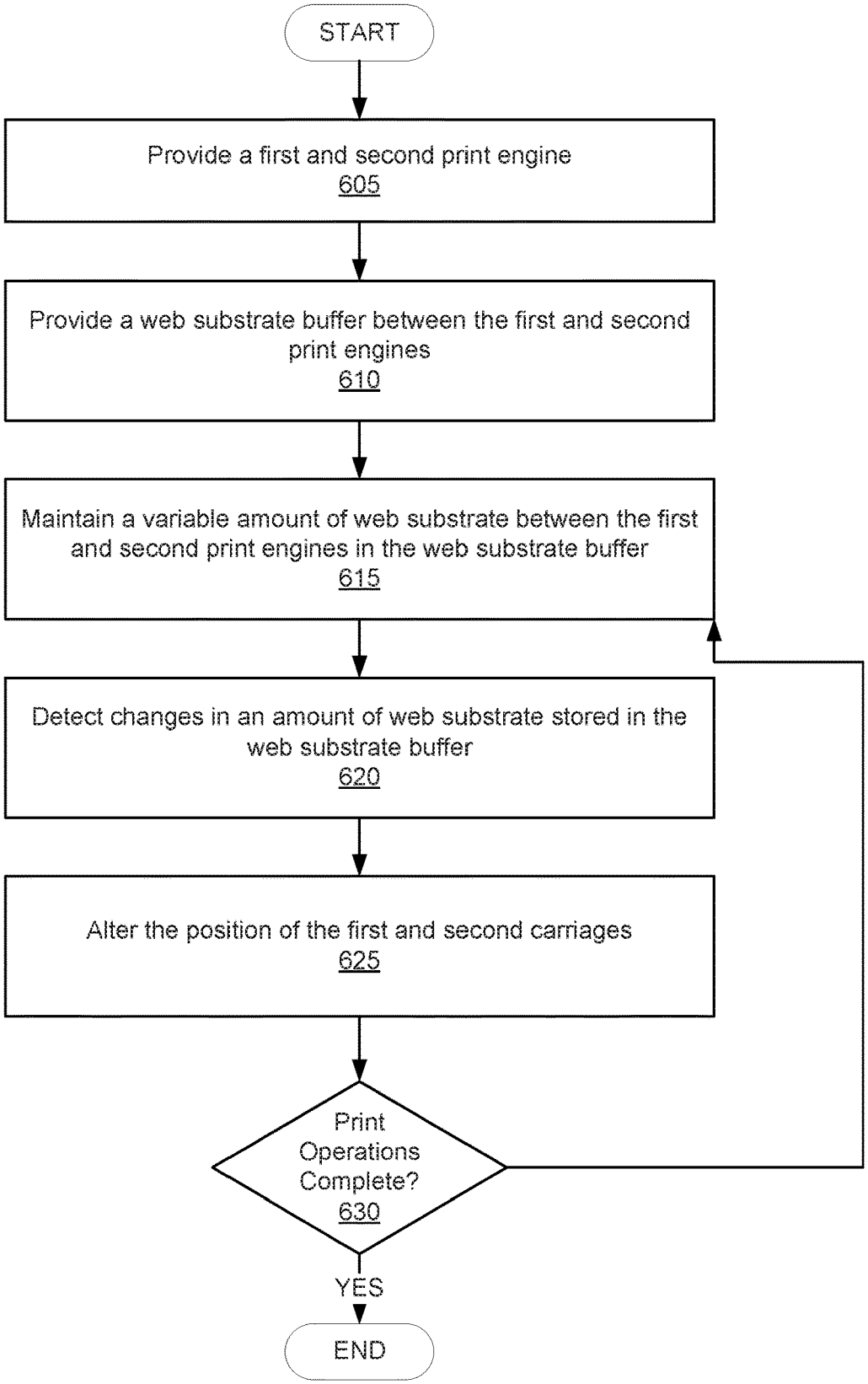
FIG. 6 is a flowchart showing a method of printing to a web substrate according to an example of the principles described herein.

FIG. 6 is a flowchart showing a method (600) of printing to a web substrate according to an example of the principles described herein. In the method (600), the first and second print engines (105, 110) may be provided (605) and a web substrate buffer (300) may be provided (610) between the first and second print engines (105, 110). The web substrate buffer (300) may have a plurality of rollers to store web substrate used by the first and second print engines (105, 110).

A varying amount of web substrate may be stored maintained (615) between the first and second print engines (105, 110) in the web substrate buffer (300). For example, the web substrate may be received into the web substrate buffer (300) after the first print engine (105) has printed to the web substrate. The web substrate buffer (300) may then feed the stored web substrate to the second print engine (110) for print operations.

A change in the amount of web substrate stored in the web substrate buffer (300) may then be detected (620). This may be done using a sensor in the web substrate buffer (300) via, for example, the linear encoder (305) and/or by continuously monitoring the amount of web substrate output from the first print engine (105) to the web substrate buffer (300) and the amount of web substrate received into the second print engine (110) from the web substrate buffer (300). Moreover, in certain examples, data may be continuously provided to the first and second print engines (105, 110) corresponding to the amount of web substrate stored in the web substrate buffer (300).

After the change is detected (620), the position of the first and second moveable carriages (120, 125) in the web substrate buffer (300) may be altered (625) to maintain a constant tension on the substrate as well as adjust the amount of web substrate within the web substrate buffer (300). For example, if the web substrate is received into the web substrate buffer (300) from the first print engine (105), the first and second moveable carriages (120, 125) may be moved to create a longer web substrate path through the web substrate buffer (300) to maintain the increased amount web substrate at a specific tension.

Conversely, if web substrate is removed from the web substrate buffer (300) by the second print engine (110), the first and second moveable carriages (120, 125) may be moved to create a shorter web substrate path through the web substrate buffer (300) to maintain relatively less web substrate within the web substrate buffer (300) at the specific tension. The change in the position of the first and second moveable carriages (120, 125) may be accomplished by selectively activating the actuator (435) in the web substrate buffer (300).

In certain examples, the web substrate may be fed through the web substrate buffer (300) by selectively driving at least one of the rollers with an electric motor or other source of mechanical energy. Once it is determined (630) that print operations have been completed in the first and second print engines (105, 110), the process may end. Otherwise, the process of maintaining (615) a varying amount of web substrate between the first and second print engines (105, 110) in the web substrate buffer (300), detecting (620) a change in the amount of web substrate stored in the web substrate buffer (300), and altering (625) the position of the first and second moveable carriages (120, 125) may be repeated as print operations continue in the first and second print engines (105, 110).

The specification and figures describe a web substrate buffer that includes two carriages that move toward or apart from each other in a synchronous manner in order to adjust the amount of web substrate maintained in the web substrate buffer. The synchronous movement of the carriages allows for a relatively larger amount of web substrate being maintained in the web substrate buffer. This may increase the serviceability and usability of a print system incorporating this web substrate buffer. Additionally, the movement of both carriages allows for a web substrate that has less or at least as much of a footprint in the system while still increasing the amount of web substrate that may be maintained in the web substrate buffer. With the increase of web substrate maintained in the web substrate buffer, printing operations may proceed as relatively quicker pace because neither the first or the second print engines are to stall as a result of the other. Instead, the web substrate may be maintained in the web substrate buffer.

The preceding description has been presented to illustrate and describe examples of the principles described. This description is not intended to be exhaustive or to limit these principles to any precise form disclosed. Many modifications and variations are possible in light of the above teaching.

What is claimed is:

1. A web substrate buffer, comprising:

a first movable carriage comprising a first number of rotatable rollers;

a second movable carriage comprising a second number of rotatable rollers; and a linear encoder to determine a distance between the first and second number of rotatable rollers and adjust the distance between the first and second number of rotatable rollers to adjust an amount of web substrate maintained within the web substrate buffer.

2. The buffer of claim 1, wherein the amount of web substrate maintained within the web substrate buffer is based on an amount of web substrate to be printed on by a first print engine and second print engine upstream and downstream, respectively, of the web substrate buffer.

3. The buffer of claim 1, further comprising a belt wherein the first movable carriage is coupled to a first portion of the belt and the second movable carriage is coupled to a second portion of the same belt such that rotation of the belt causes the first movable carriage and second movable carriage to move toward or away from each other simultaneously.

4. The buffer of claim 3, wherein the first portion of the belt is a top portion and the second portion of the belt is a bottom portion of the same belt.

5. The buffer of claim 3, further comprising a tensioning mechanism to adjust tension of the belt.

6. The buffer of claim 3, further comprising an inspection table to inspect printing on a web in the buffer from a print engine upstream of the buffer.

7. The buffer of claim 1, further comprising a turn bar to turn the web substrate over from a first side to a second side.

8. The buffer of claim 1, wherein the linear encoder comprises a magnet on the first or second movable carriage to indicate a position of that carriage.

9. The buffer of claim 1, wherein the first and second movable carriages move synchronously.

10. The buffer of claim 1, the linear encoder to output a signal a first print engine upstream of the buffer to selectively pause print operations based an amount of web in the buffer.

11. The buffer of claim 1, the linear encoder to output a signal to a second print engine downstream of the buffer to selectively pause print operations based an amount of web in the buffer.

12. The buffer of claim 1, further comprising:

an input to receive a web from a first print engine;

an output to output the web to a second print engine;

the linear encoder to detect the position of at least one of the first and second carriages;

wherein the first and second movable carriages move to alter an amount of web present in the web substrate buffer; and wherein the linear encoder sends data describing the amount of web substrate being maintained in the web substrate buffer to control circuitry associated with a printing device comprising the first and second print engines.

13. The buffer of claim 12, wherein the linear encoder sends extrapolated data, in real time, describing the amount of web substrate being maintained in the web substrate buffer.

14. The buffer of claim 12, further comprising a data input to receive instructions from the control circuitry directing the web substrate buffer device to increase, maintain, or decrease an amount of web substrate maintained in the web substrate buffer.

15. The buffer of claim 12, the linear encoder to output a signal to the first print engine upstream of the buffer to selectively pause print operations based on capacity of the buffer indicated by the signal.

16. The buffer of claim 12, the linear encoder to output a signal to the second print engine downstream of the buffer to selectively pause print operations based on capacity of the buffer indicated by the signal.

17. The buffer of claim 12, further comprising a belt to move the two movable carriages synchronously away and towards each other to alter an amount of web present in the buffer.

18. The buffer of claim 17, wherein the first carriage is coupled to a first part of the belt and the second carriage is coupled to a second part of the same belt apart from the first part.

19. The buffer of claim 12, further comprising a turn bar to turn over the web substrate from a first printable side to a second printable side between the input to receive a web from the first print engine and the output to output the web to the second print engine.

20. The buffer of claim 12, the first and second movable carriages to maintain the web at a constant operational tension.

* * * * *